United States Patent [19]

Niles

[11] 4,216,959

[45] Aug. 12, 1980

[54] WEIGHT LIFTER SAFETY CHAIN

[76] Inventor: Arthur B. Niles, P.O. Box 6515, 1409 T St. Station, Washington, D.C. 20009

[21] Appl. No.: 900,774

[22] Filed: May 1, 1978

[51] Int. Cl.[3] ..... A63B 13/00

[52] U.S. Cl. ..... 272/123; 24/73 CE; 272/144; 272/DIG. 2

[58] Field of Search ..... 272/123, 117, 116, 130, 272/138, 135, 143, 144, DIG. 2, DIG. 4, 134; 278/51, 54; 187/8.47, 8.49; 182/141; 280/428, 432, 480, 457

[56] References Cited

U.S. PATENT DOCUMENTS

| | | | |
|---|---|---|---|
| 3,235,255 | 2/1966 | Leflar | 272/123 |
| 3,265,407 | 8/1966 | Paddock | 280/432 X |
| 3,346,256 | 10/1967 | White | 272/123 X |
| 3,608,931 | 9/1971 | Skromme | 280/457 |
| 3,921,766 | 11/1975 | May | 280/428 |

FOREIGN PATENT DOCUMENTS

| | | | |
|---|---|---|---|
| 456790 | 3/1928 | Fed. Rep. of Germany | 272/123 |

*Primary Examiner*—Richard C. Pinkham
*Assistant Examiner*—William R. Browne

[57] ABSTRACT

A weight lifting manually adjustable safety chain device for use with weight lifting barbells, for use during bench press, squat-type weight support exercises; said chain device having a metallic ring mounted on one end, further having a round fast eye bolt snap hook and a circular hinge clamp attached to the other end of said chain. Said metallic ring is constructed to hang from a barbell rest cradle and said hinge clamp is constructed to be fastened around a bar of a barbell: thereby, permitting said barbell to hang suspended over the chest or neck and shoulders of an exerciser.

1 Claim, 5 Drawing Figures

Fig. 1
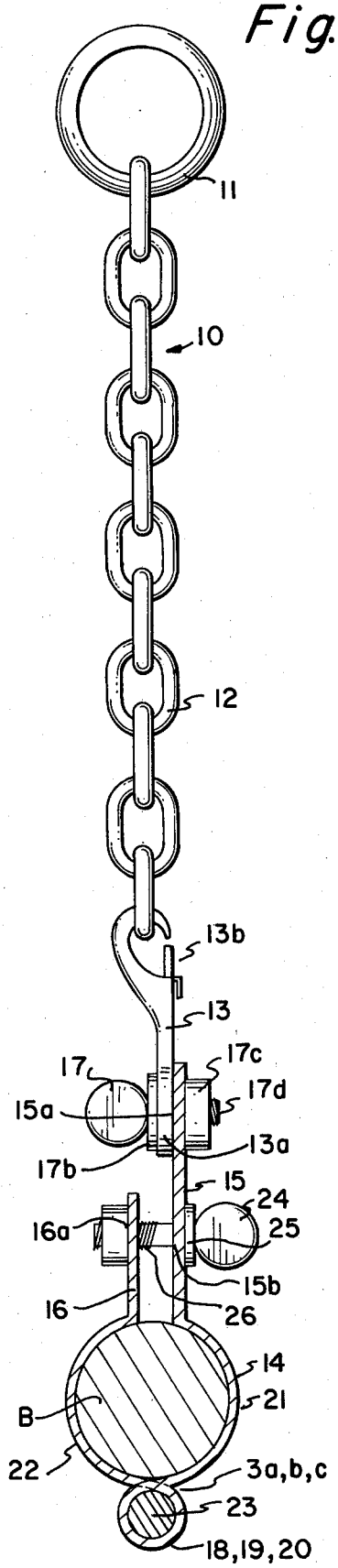
Fig. 2
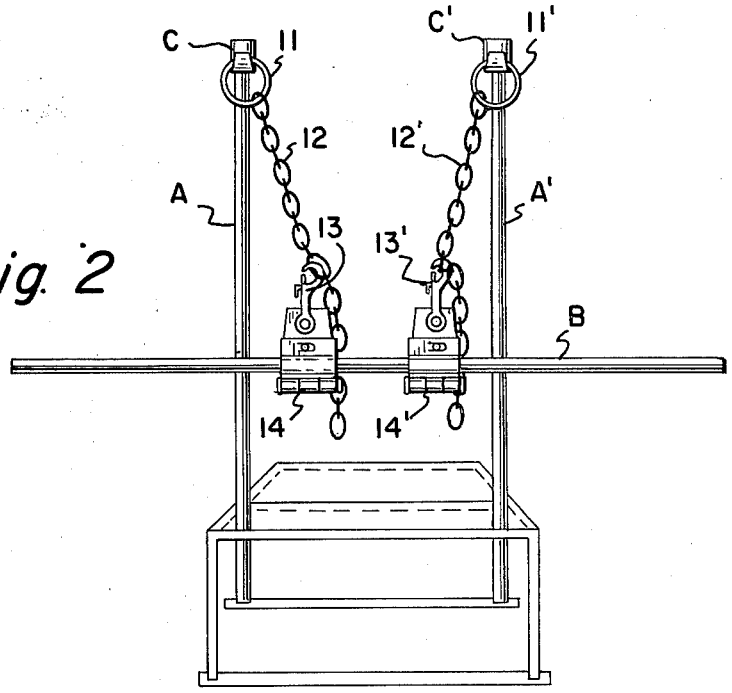
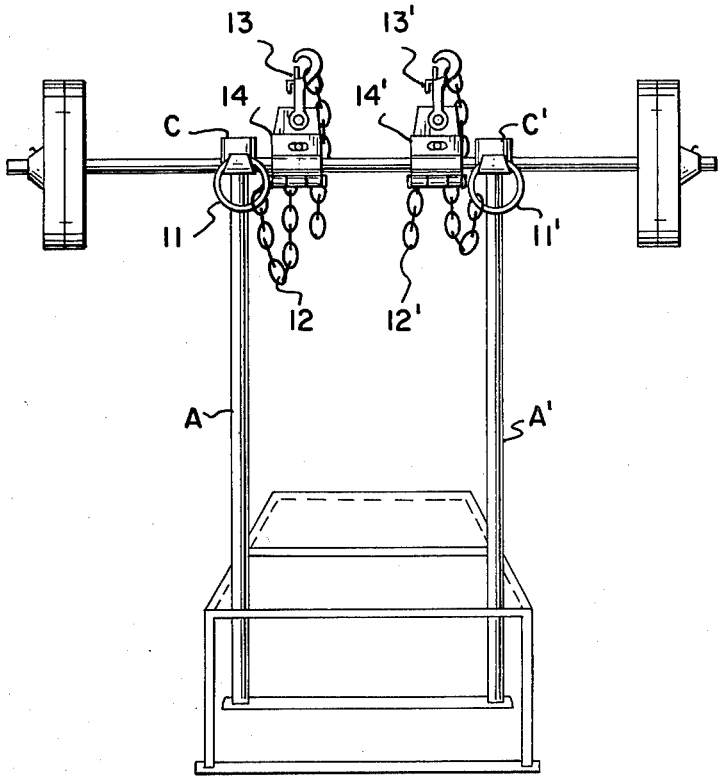
Fig. 3

Fig. 4
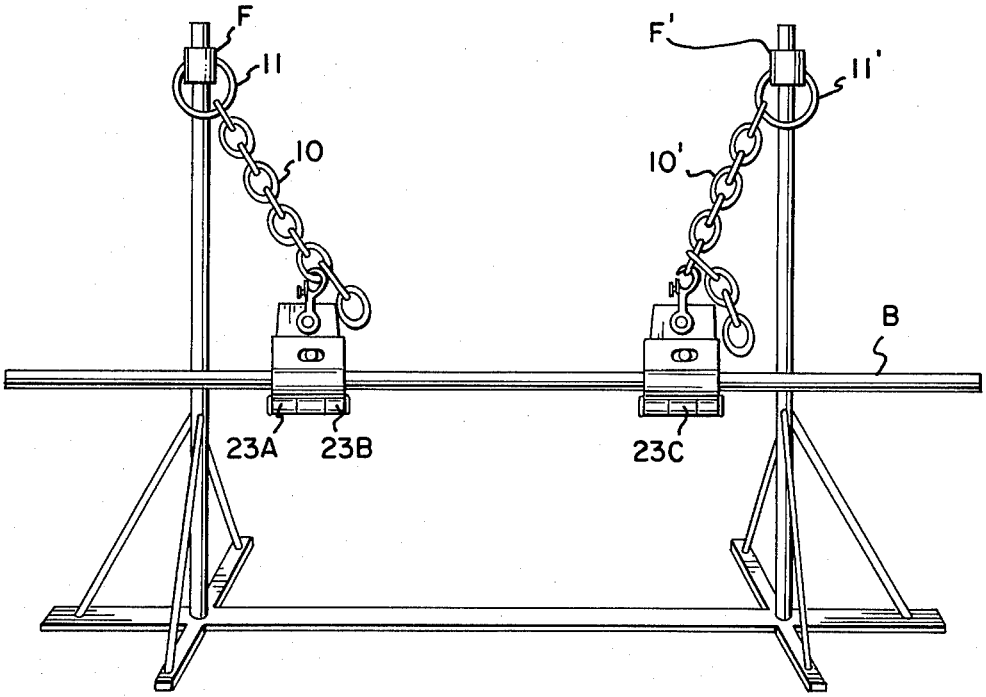
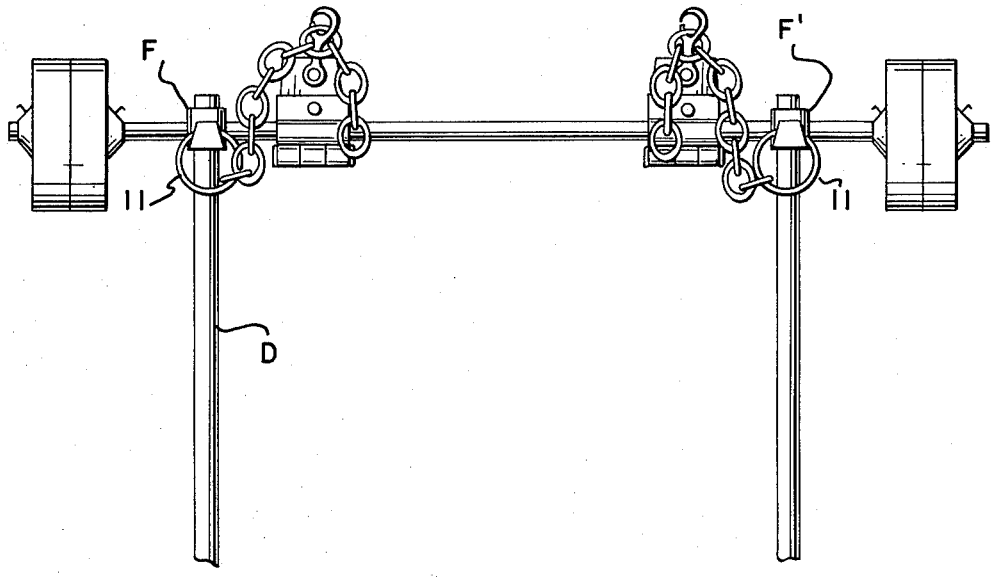
Fig. 5

WEIGHT LIFTER SAFETY CHAIN

BACKGROUND OF THE INVENTION

This invention is in the field of weight lifting exercises. It relates to the safety of the lifter during bar bell bench press and squat-type exercises and more particularly to an improvement device for bar bell bench press and squat-type exercise devices utilizing the bar bell rest cradles.

(Note) Said safety chain device is understood to be connected to the bar bell, bench press rack and squat-type devices but neither of these are part of my invention and are drawn only to help simplify the complete operation of the invention.

In the prior art, bench press and squat devices which are constructed with the U,V, or arc shape cradles on the support stands, said bar bell is place losely or freely resting on two fixed vertical arm supports about 16 inches (for bench press) in a comfortable reaching distance above the exerciser's chest; and about neck or shoulder standing height for squat-type devices. This permit the exerciser enough space to get under the bar bell and lay on the bench or stand under the squat device bar bell and lift the weight off the vertical arms and then he does his exercises. In both examples after completing his exercises he must put the weights back up on the two arm support cradles in order to get out from under the bar bell. Weight lifting devices operates with relatively heavy weights, ordinarily 75 lbs. to 400 lbs. and once the weight is removed or lifted off it's support stands it is freely supported by the power of the user and the weight is now on top of the exerciser.

It is very easily viewed that in the prior art devices, if an exerciser is unable to put the bar bell back on the vertical supports, he would become trapped under the weight which is on his chest or shoulders behind the neck. The prior art system of bar bell bench press and squat-type devices are thus extremely dangerous for a person to exercise alone and further requires another to assist the exerciser to put the bar bell back up on the cradles of the arm supports.

There in the prior art some devices which are intended for doing bench and squat lift exercises without the disadvantages of the bar bell bench and squat previously mentioned; but, these have proven unsatisfactory since they either are an inconvenience to the user, have not solve the safety problem and, or are very costly, due to the fact that a consumer who already have one unsafe device would require additional finance to purchase a new complete safe design.

It is a primary object of this invention to construct a simple inexpensive safety chain device which would provide greater safety while exercising alone or with another person. This is done by making the exerciser a means of easily controlling the bar bell after it has been lifted off the bar bell rest cradles of the support arms; and further provide the necessary means to hold the bar bell suspended a predetermine distance over an exhausted exerciser's chest or neck and shoulders thereby allowing him to get out from under the bar bell without any assistance.

Another advantage of this invention is that each link of the chain can be use to adjust the length needed using the bar bell to the satisfaction of the exerciser by simply moving the provided snap hook into another link of the chain for a convenient simple means of handling.

Another advantage is that the device is very easily attached and interchangeable to be use on the bench press as well as the squat type devices; therefore consumers who own a bench press or a squat device which is unsafe will only need purchase this inexpensive safety chain device, thereby reducing the cost to consumer.

BRIEF DESCRIPTION OF THE DRAWINGS

The above mentioned and other features and objects of this invention will become apparent when taken in conjunction with the following drawings in which like reference refer to like parts thereof through out the various views and diagrams, and in which:

FIG. 1 is a perspective view of the complete safety device vertically arranged and showing the entire invented device having it's hinge clamp fasten around the bar bell.

FIG. 2 is a front view showing a pair of the safety chain device in an incline or vertical position and attached to the bench arm support cradles; further showing the lowered suspended or hanging bar bell connected to the extended chains.

FIG. 3 is a front view showing a pair of the safety devices in a folded position and attached to the bench arm support cradles, the bar bell with the desired weights and resting in the weight rest cradles.

FIG. 4 is a front view showing a pair of the safety chain devices in an incline or vertical position attached on one end to the arm support cradles of the squat-type exercise device; further showing the lowered suspended or hanging bar bell connected to the extended chains.

FIG. 5 is a front view of a squat-type device showing a pair of the safety chain device in a folded position and attached to the arm support cradles; further showing the bar bell with the desired weights resting in the weight rest cradles.

PREFERRED EMBODIMENT

From the drawings it will be seen that the invented safety chain device 10 comprises four essential portions; an annular metallic ring 11, a chain 12, a round fast eye bolt snap hook 13 and a circular hinge clamp 14.

Returning now to FIG. 1 of the drawings. The safety chain device 10 is arranged in a vertical position showing the annular metalic ring 11, linked or mounted to a link on one end of chain 12; further showing, a round fast eye bolt snap hook 13 with the snap hook portion **13*b* fasten around the other end of chain 12, thus providing the user with a quick method for connecting and adjusting the device to the barbell B. FIG. 1 further shows the circular hinge clamp 14 having two flat ends 15 and 16, which are bored to provide the holes 15*a*, 15*b*, and 16*a*, and further having two semi-circular shaped portions 21 and 22 which are hinged together by a pintle pin or bolt 23 that is fasten by a nut or riveted through the hinge eyes 18,19 and 20; the hinge eyes 18,19, and 20 being welded for strength at 23*a*, 23*b* and 23*c*. The circular hinge clamp 14 is viewed bolted to the round fast eye 13 by the thumb screw 17 which is inserted through washer 17*b*, the fast eye portion 13*a*, hole 15*a* of flat end 15 and screwed into the threads 17*d* of nut 17*c*; further showing the hinge clamp 14 having the circular portion 21 and 22 bolted around the bar B, by the thumb screw 24 inserted through washer 25, hole 15*b*, 16*a* of the flat ends 15 and 16 turn or fasten by nut 26**.

I have thus explain how the device is made. (note)—that since the device operates in pairs, the following information is included to simplify the drawings.

FIG. 2 shows a hanging pair of the safety chain device 10 and 10' having their cradle rest rings 11 and 11' attached from the back around and on to the cradles C and C' and jamming against the back vertical portion of the arm supports A and A'; showing both safety chain devices hanging in-between the space created by the arm supports. Chains 12 and 12' are seen connected at a link of each chain by the snap hooks 13 and 13'; further showing the round fast eye bolt snap hooks in turn fasten to the bar bell hinge clamps 14 and 14', in turn fasten around a bar bell B, as previously explianed in FIG. 1.

FIG. 2 further shows the bar bell in a lowered position and the exerciser has set or adjust the bar bell a desired height above his chest to provide sufficient space to pull himself out from under the bar bell; should he become exhausted and is unable to push or lift the weighted bar bell back up on the rest cradles, he simply let the bar bell hang suspended.

FIG. 3 is a front view showing a pair of the safety chains 14 and 14' attached to the bench arm support cradles C and C'. In this position the device chains are folded, and the bar bell with the desired weights is resting in the weight rest cradles C and C'. The exerciser can begin his exercise since the weighted bar bell height above his chest has been pre-adjusted and the danger of being trapped under the bar bell has been removed by the use of the chain devices.

FIG. 4 is a front view showing a pair of the safety chain devices 10 and 10' attached in an incline or vertical position to the arm support cradles F and F' of the squat-type exercise device D; further showing the bar bell B suspended by said safety chains and connected as previously explained in FIG. 1. In this position the bar bell is pre-adjusted and lowered, removed from the rest cradles and is understood to be behind the neck and on the shoulders of the exercises. Should the exerciser become exhausted, he simply release the bar and bend under the bar bell letting the bar bell hang suspended.

FIG. 5 is a front view of a squat-type device showing the weighted bar bell B resting in the cradles F and F' of the arm supports, with the safety chain device 10 and 10' attached as previously explained in FIG. 1. In this position the exerciser can begin his exercise since the height of the bar bell has been preadjusted for squatting and to provide enough space for the user to easily bend under said bar bell leaving it suspended.

Thus I have described a preferred embodiment of the invention which is here made by way of example only. This invention is not to be taken as limited to the specific embodiment of the invention described therein but includes all such modifications being within the spirit and scope of the invention claimed, it is indicated that all matter contain therein is intended as illustrative and not as limited in scope.

What I claim as invention is:

1. The combination of a manually adjustable safety chain and a barbell support for supporting a barbell comprising: a chain means for supporting a barbell; said chain means comprising two separate chains, each chain having mounted at one end an annular metallic ring; said ring being attached to be hung from a barbell rest cradle; said chain means further including a round fast eye bolt snap hook means connecting said chain means to a barbell; said snap hook means including a circular hinge clamp having two flat ends and two semi-circular shaped portions, said clamp being peripherally joined in a retractable hinged relation at a point adjacent said two semicircular portions; said snap hook means including means connecting together both said retractable hingedly mounted ends of said flat plate of said hinge clamp so as to fasten said clamp around a bar of a barbell; and means connecting said snap hook means to said hinge clamp.

* * * * *